US010710087B2

(12) United States Patent
Viilo et al.

(10) Patent No.: US 10,710,087 B2
(45) Date of Patent: Jul. 14, 2020

(54) JAW CRUSHER, MINERAL MATERIAL PROCESSING PLANT AND METHOD FOR PROCESSING MINERAL MATERIAL

(71) Applicant: Metso Minerals, Inc., Helsinki (FI)

(72) Inventors: Keijo Viilo, Tampere (FI); Janne Rannanpää, Nokia (FI)

(73) Assignee: Metso Minerals, Inc., Helsinki (FI)

( * ) Notice: Subject to any disclaimer, the term of this patent is extended or adjusted under 35 U.S.C. 154(b) by 265 days.

(21) Appl. No.: 15/570,970

(22) PCT Filed: Apr. 22, 2016

(86) PCT No.: PCT/FI2016/050263

§ 371 (c)(1),
(2) Date: Oct. 31, 2017

(87) PCT Pub. No.: WO2016/181032

PCT Pub. Date: Nov. 17, 2016

(65) Prior Publication Data

US 2018/0290145 A1 Oct. 11, 2018

(30) Foreign Application Priority Data

May 13, 2015 (FI) ..... 20155346

(51) Int. Cl.
*B02C 1/04* (2006.01)
*B02C 1/02* (2006.01)
*B02C 1/06* (2006.01)

(52) U.S. Cl.
CPC ..... *B02C 1/04* (2013.01); *B02C 1/02* (2013.01); *B02C 1/06* (2013.01)

(58) Field of Classification Search
CPC ..... B02C 1/02; B02C 1/04; B02C 1/06
See application file for complete search history.

(56) References Cited

U.S. PATENT DOCUMENTS 1,936,742 A 11/1933 Youtsey
2,257,388 A * 9/1941 Krider ..... B02C 1/04 241/217

(Continued)

FOREIGN PATENT DOCUMENTS

CN 87103586 A 11/1987
CN 2052684 U 2/1990

(Continued)

OTHER PUBLICATIONS

Office Action and Search Report for corresponding Chinese Patent Application No. 201680027571.1 dated Aug. 30, 2018.

(Continued)

*Primary Examiner* — Faye Francis
(74) *Attorney, Agent, or Firm* — Andrus Intellectual Property Law, LLP

(57) ABSTRACT

A jaw crusher, a mineral material processing plant and a method for processing mineral material. The jaw crusher includes a fixed jaw and a movable jaw for forming a crushing chamber therebetween which is open at the top. The fixed jaw includes a first wear part mounted thereto and the movable jaw includes a pitman and a second wear part mounted thereto. The pitman is rotatably mounted to a first eccentric shaft. The pitman is further rotatably mounted to second eccentric shaft configured to guide the stroke of the movable jaw to create a movement pattern with a substantially linear crushing stroke, wherein the eccentricity of the second eccentric shaft is larger than that of the first eccentric shaft.

12 Claims, 2 Drawing Sheets

(56) References Cited

U.S. PATENT DOCUMENTS

| | | | | | |
|---|---|---|---|---|---|
| 3,984,058 | A * | 10/1976 | Archer | B02C 1/04 | 241/264 |
| 4,248,390 | A | 2/1981 | Toole | | |
| 4,288,040 | A * | 9/1981 | Miller | B02C 21/02 | 241/263 |
| 4,382,560 | A | 5/1983 | Toole | | |
| 7,143,970 | B2 * | 12/2006 | Ha | B02C 1/005 | 241/268 |
| 2004/0129814 | A1 * | 7/2004 | Ha | B02C 1/005 | 241/267 |
| 2005/0173574 | A1 * | 8/2005 | Lehtonen | B02C 1/10 | 241/264 |
| 2012/0018558 | A1 * | 1/2012 | Gervais | B02C 1/04 | 241/101.74 |
| 2013/0233956 | A1 * | 9/2013 | Lehtonen | B02C 1/10 | 241/198.1 |
| 2018/0071742 | A1 * | 3/2018 | Grimm | B02C 1/04 | |

FOREIGN PATENT DOCUMENTS

| | | | |
|---|---|---|---|
| CN | 201244496 | Y | 5/2009 |
| CN | 202061645 | U | 12/2011 |
| CN | 103908986 | A | 7/2014 |
| CN | 203874819 | U | 10/2014 |
| DE | 494038 | C | 3/1930 |
| DE | 10206709 | A1 | 8/2003 |
| DE | 102012009989 | A1 | 11/2013 |
| GB | 887349 | A | 1/1962 |
| JP | H02-001244 | U | 1/1990 |
| JP | 3052632 | U | 9/1998 |
| JP | 2004-209308 | A | 7/2004 |
| RU | 2144426 | C1 | 1/2000 |
| RU | 2345837 | C2 | 2/2009 |
| RU | 2458740 | C1 | 8/2012 |
| SU | 579007 | A1 | 11/1977 |
| SU | 1080846 | A | 3/1984 |
| WO | 9415713 | A1 | 7/1994 |
| WO | 2013/171361 | A1 | 11/2013 |
| WO | 2014139708 | A1 | 9/2014 |
| WO | 2015/071525 | | 5/2015 |

OTHER PUBLICATIONS

Office Action for Chinese Patent Application No. 2016800275711 dated May 8, 2019.
Finnish Search report for FI 20155346 dated Dec. 11, 2015.
International Search report and Written Opinion for PCT/FI2016/050263 dated Nov. 17, 2016.
International Preliminary Report on Patentability for PCT/FI2016/050263 dated Mar. 29, 2017.
Office Action for Russian Patent No. 2017140466 dated Oct. 28, 2019.

* cited by examiner

JAW CRUSHER, MINERAL MATERIAL PROCESSING PLANT AND METHOD FOR PROCESSING MINERAL MATERIAL

CROSS REFERENCE TO RELATED APPLICATIONS

This application is the U.S. national stage application of International Application PCT/F12016/050263 filed Apr. 22, 2016, which international application was published on Nov. 17, 2016, as International Publication WO 2016/181032 in the English language. The International Application claims priority of Finish Patent Application 20155346, filed May 13, 2015.

TECHNICAL FIELD

The invention relates to mineral material processing. In particular, but not exclusively, the invention relates to jaw crushers. In particular, but not exclusively, the invention relates to a driving mechanism of a jaw crusher.

BACKGROUND ART

The function of a jaw crusher is based on a force is compressing the material to be processed. An eccentric shaft is attached to a body of the jaw crusher to which eccentric shaft is connected a movable jaw, i.e. a pitman, making an eccentric movement relative to a fixed jaw.

The movement of the movable jaw is decisive to the capacity and effectiveness of the crusher. The forward movement of the jaw, i.e. the crushing stroke, depends on the movement of the movable jaw and often contains upward and downward movement reducing the efficiency of the stroke.

Previously, improvements to the movement pattern of the movable jaw have been carried out by attaching the pitman to a pivot bar, resulting in a movement pattern having the shape of a flattened oval. Such an arrangement is known from patent application publication WO 2013/171361 A1. However, such an arrangement requires an undesirable amount of space inside the pitman and the crusher frame for the pivot bars and a more complex design requiring careful consideration e.g. in lubrication.

Furthermore, improvements to the movement pattern of the movable jaw have previously been carried out by attaching the pitman to slide member moving in a direction perpendicular to the centerline of the crushing chamber, resulting in a movement pattern having the shape of a flattened oval. Such an arrangement has been disclosed in an unpublished patent application PCT/FI2013/051074.

An object of the invention is to create an alternative crusher by which drawbacks present in connection with known crushers can be eliminated or at least reduced.

SUMMARY

According to a first example aspect of the invention there is provided a jaw crusher comprising a fixed jaw and a movable jaw for forming a crushing chamber therebetween which is open at the top, the fixed jaw comprising a first wear part mounted thereto and the movable jaw comprising a pitman (4) and a second wear part mounted thereto; wherein the pitman is rotatably mounted to a first eccentric shaft, and wherein the pitman is further rotatably mounted to second eccentric shaft configured to guide the stroke of the movable jaw to create a movement pattern with a substantially linear crushing stroke, wherein the eccentricity of the second eccentric shaft is larger than that of the first eccentric shaft.

A substantially horizontal line passing through the center of the first eccentric shaft may pass through the lower or upper dead center of the second eccentric shaft.

The substantially horizontal line passing through the centre of the first eccentric shaft may pass through the middle section of the crushing chamber.

The substantially horizontal line passing through the centre of the first eccentric shaft may substantially pass through the centerline of the crushing chamber thus dividing the crushing chamber into two parts of equal height.

The second eccentric shaft may be configured to swing back and forth in response to the first eccentric shaft rotating.

The second eccentric shaft may be positioned between the first eccentric shaft and the crushing chamber.

The second eccentric shaft may be mounted in such a way that the upper or lower dead center thereof is removed from the horizontal line.

The first eccentric shaft and the second eccentric shaft may be bearing-mounted to a body of the jaw crusher and to the pitman.

The radius of the second eccentric shaft may be substantially between 2 and 4 times that of the radius of the first eccentric shaft.

According to a second example aspect of the invention there is provided a mineral material processing plant comprising a jaw crusher according to the first example aspect of the invention.

The mineral material processing plant may be a mobile processing plant.

According to a third example aspect of the invention there is provided a method for processing mineral material in a jaw crusher to the first example aspect of the invention or in a mineral material processing plant according to the second example aspect of the invention by directing a substantially linear crushing stroke to the material to be crushed in the crushing chamber by swinging the second eccentric shaft back and forth in response to the first eccentric shaft rotating.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
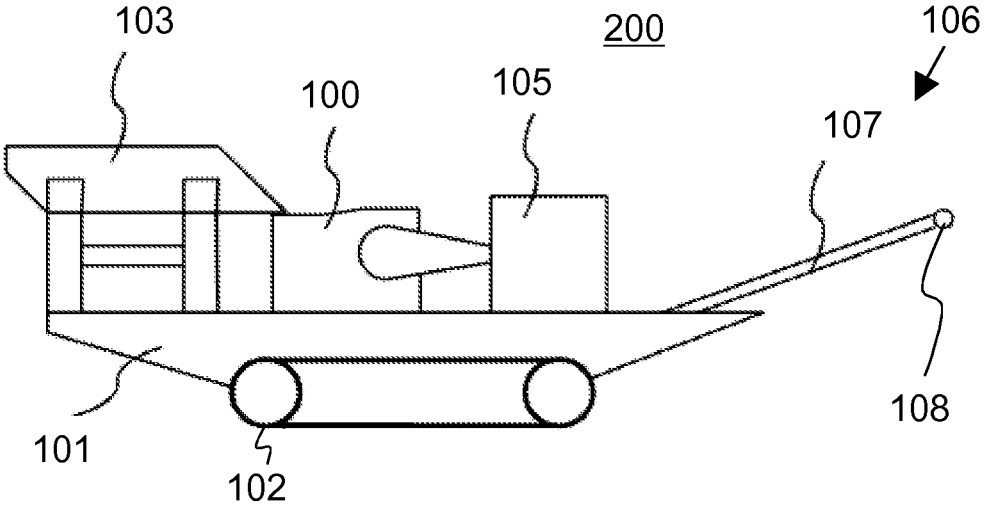
FIG. 1 shows a side view of a mineral material processing plant in which embodiments of the invention are to be implemented.

FIG. 1 shows a mineral material processing plant in which embodiments of the invention are implemented. FIG. 1 shows a crushing plant 200 comprising a jaw crusher 100. The crushing plant 200 has a feeder 103 for feeding the material to the jaw crusher 100 and a belt conveyor 106 for transporting the crushed material further from the crushing plant.

The belt conveyor 106 shown in FIG. 1 comprises a belt 107 adapted to pass around at least one roller 108. The crushing plant 200 comprises also a power source and a control unit 105. The power source is for example a diesel motor or an electric motor that is provides energy for process units and hydraulic circuits (not shown).

The feeder 103, the crusher 100, the power source 105 and the conveyor 106 are attached to a body 101 of the crushing plant which in an embodiment further comprises a track base 102 for moving the crushing plant 200. The crushing plant, in a further embodiment, is wholly or partly wheel based or movable on legs or skids. Alternatively, in a still further embodiment, the crushing plant 200 is movable/towable for example by a truck or another external power source. In a still further embodiment, the crushing plant is a fixed plant.

The mineral material to be processed is for example mined rock, asphalt or construction demolition waste such as concrete or bricks etc.

Figure 2:
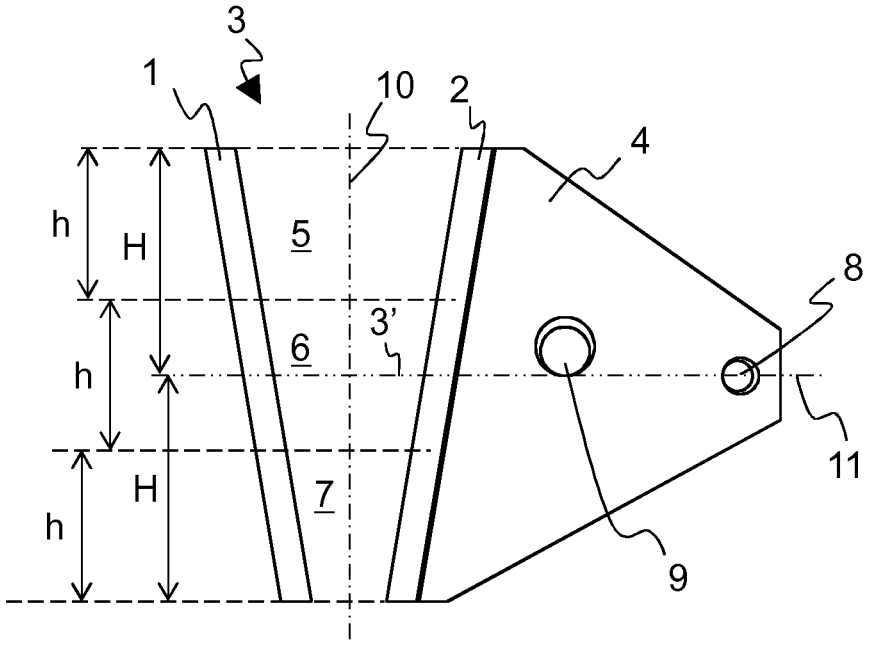
FIG. 2 shows a side view of a driving mechanism according to an embodiment of the invention.
Figure 3:
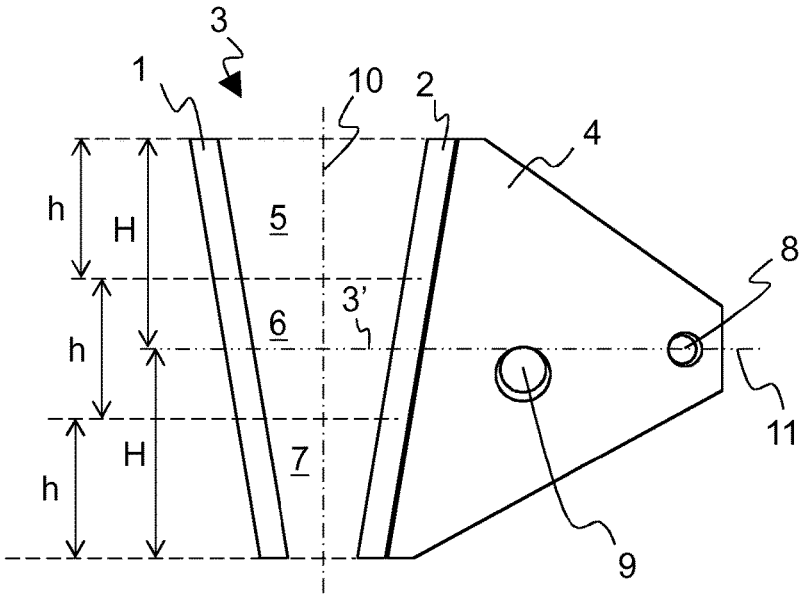
FIG. 3 shows a side view of a driving mechanism according to an embodiment of the invention.

Embodiments of the driving mechanism of a jaw crusher 100 shown in FIGS. 2 and 3 are used for example in the crushing plant 200 of FIG. 1.

The jaw crusher 100 shown in FIGS. 1 to 3 comprises a fixed jaw and a movable jaw forming a crushing chamber 3 therebetween. The crushing chamber is open at the top. A first wear part 1 is attached to the fixed jaw and a second wear part 2 is fixed to a pitman 4. In FIGS. 2 and 3, the fixed jaw is represented by the wear part 1 attached to the fixed jaw and the movable jaw is represented by the wear part 2 attached to a pitman 4. The crushing chamber 3 comprises an upper section 5, a middle section 6, and a lower section 7 having equal heights h. The driving mechanism of the jaw crusher is based on an attachment of the pitman 4 to a first eccentric shaft 8 and to a second eccentric shaft 9, i.e. the pitman is mounted on the first eccentric shaft 8 and to the second eccentric shaft 9. FIGS. 2 and 3 further show a vertical diagonal 10 of the crushing chamber 3. In an embodiment, a substantially horizontal line 11 passing through the centre of the eccentric shaft 8 passes through the middle section 6 of the crushing chamber 3.

In a further embodiment, the substantially horizontal line 11 passing through the centre of the eccentric shaft 8 substantially passes through the horizontal centerline 3' of the crushing chamber 3 thus dividing the crushing chamber into two parts of equal height H.

The first eccentric shaft 8 is rotatably bearing-mounted to the pitman 4 and to the body (not shown in FIGS. 2 and 3) of the jaw crusher. In a further embodiment, instead of the body of the jaw crusher, the first eccentric shaft 8 is mounted to a further support structure of the jaw crusher. The eccentricity of the first eccentric shaft is used to create the stroke of the pitman 4 and thus the movable jaw. In an embodiment, the eccentricity of the first eccentric shaft 8 is equal a half of the stroke length of the movable jaw.

The pitman 4 is additionally supported to the body by the second eccentric shaft 9. The second eccentric shaft 9 is rotatably bearing-mounted to the pitman 4 and to the body (not shown in FIGS. 2 and 3) of the jaw crusher. In a further embodiment, instead of the body of the jaw crusher, the second eccentric shaft 9 is mounted to the same further support structure of the jaw crusher as the first eccentric shaft 8. The eccentricity of the second eccentric shaft 9 is used, as explained hereinafter with reference to FIG. 5 to guide the movement of the pitman, i.e. the stroke of the pitman 4, and thus the movable jaw, thereby creating a desired movement pattern for the movable jaw.

In an embodiment, the radius of the second eccentric shaft 9 is about 2 to 4 times the radius of the first eccentric shaft 8, i.e. the eccentricity of the second eccentric shaft 9 is larger than that of the first eccentric shaft 9 in order to create the desired movement pattern. The second eccentric shaft 9 is positioned between the first eccentric shaft 8 and the crushing chamber. In an embodiment, the vertical position of the second eccentric shaft 9 is chosen in such a way that a dead center of the eccentric movement is substantially positioned at the horizontal line 11, i.e. at the same level as the center of the first eccentric shaft 8, resulting in a substantially horizontal crushing stroke. In an embodiment of the invention, the diameter or the radius ratio of the first eccentric shaft 8 and the second eccentric shaft 9 is preferably 1/2.

In an embodiment shown in FIG. 2, the second eccentric shaft is positioned above the horizontal line 11 so that the lower dead center is substantially at the line 11. In an embodiment shown in FIG. 3, the second eccentric shaft is positioned below the horizontal line 11 so that the upper dead center is substantially at the line 11. In a further example embodiment, the second eccentric shaft is tilted with respect to the horizontal line 11, so that the mounting point on the body and on the pitman 4 are not on the same vertical line. In a still further example embodiment, if a non-horizontal crushing stroke of the pitman is desired, the second eccentric shaft 9 is mounted vertically on a different level with the first eccentric shaft 8, so that the dead center is removed from the horizontal line 11.

The first 8 and second 9 eccentric shaft are mounted to the body of the crusher and to the pitman in a conventional manner, rotatably with bearings, i.e. bearing-mounted. In an embodiment, similar bearings and further arrangements, such as dust sealing means, are used for both.

Figure 4:
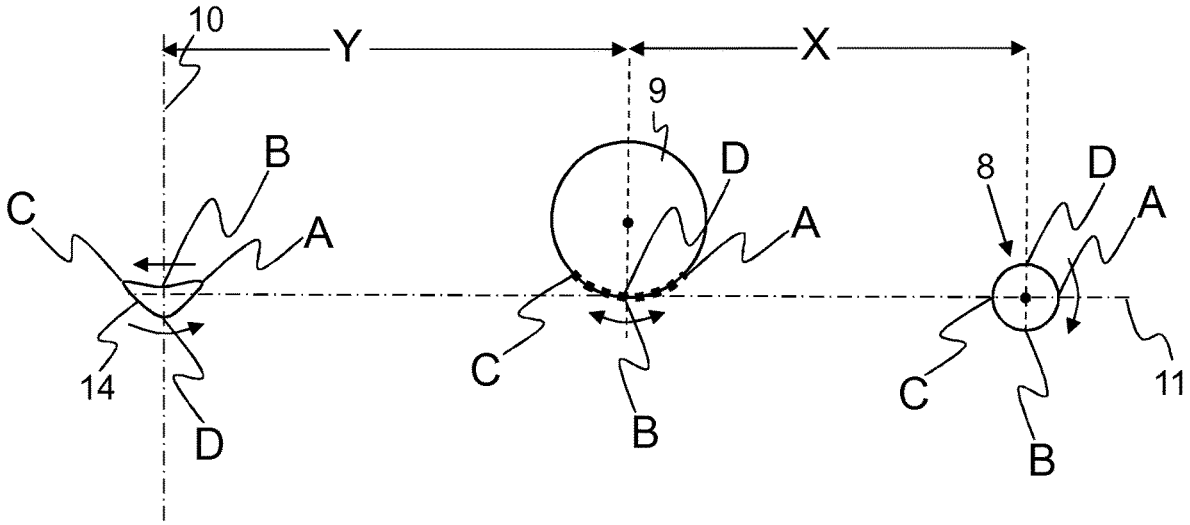
FIG. 4 shows a view of the mounting of an eccentric shaft according to an embodiment of the invention.

In a still further example embodiment (not shown in FIGS.), the first eccentric shaft 8 and the second eccentric shaft 9 are positioned on different sides of the crushing chamber, and the stroke created by the first eccentric shaft 8 is relayed to the pitman 4 and the movable jaw using conveying means such as rods or bars and the eccentricity of the second eccentric shaft 9 is used to guide the movement of the pitman, i.e. the stroke of the pitman 4, and thus the movable jaw, thereby creating a desired movement pattern for the movable jaw, in a manner similar to that explained hereinafter with reference to FIG. 4.

Preferably the vertical diagonal 10 of the crushing chamber 3 has the direction of the gravitation as shown in the FIGS. 2 to 3. Thus the crushing chamber 3 can be constructed so that the wear parts 1, 2 of the fixed jaw and the movable jaw wear equally, for example when the opposite wear parts 1, 2 have the equal inclination angle in opposite directions relative to the vertical. Generally the vertical diagonal 10 of the crushing chamber 3 has the direction of a line which halves the nip angle in the crushing chamber 3, i.e. the direction of a bisector of the crushing chamber. The figures of this description are drawn in the preferable situation when the bisector of the crushing chamber has the direction of the gravitation.

In mineral material crushing the opening and jaw angle of the crushing chamber must in practice have a certain size for example for feeding stones to the crushing chamber. By the jaw angle adjustment of the crushing chamber the efficient crushing can be affected such that the material to be crushed is kept in place and does not move upwards on the surfaces of the wear parts fixed to the fixed jaw and to the pitman. The pitman 4 can be moved substantially perpendicularly relative to the diagonal 10 of the crushing chamber 3 when there is crushed with crushers according to preferable embodiments of the invention wherein the jaw angle can in some cases be increased compared to prior art. Then, the crusher can also be lowered if necessary.

The setting and the jaw angle of the jaw crusher can be adjusted by adjusting apparatuses (not shown in the FIGS.) preferably located in an upper end and a lower end of the fixed jaw. Preferably overload protecting devices are integrated in these adjustment apparatuses.

The driving mechanism of the movable jaw enables an optimal stroke in a direction perpendicular to the diagonal 10 of the crushing chamber 3. The principle of operation of the invention is shown in FIG. 4. The principle is described with the position of the second eccentric shaft 9 as in the embodiment of FIG. 2. FIG. 4 shows the horizontal line 11 in an embodiment bisecting the crushing chamber 3 and the vertical diagonal 10 of the crushing chamber 3. The first eccentric shaft is rotated in a clockwise direction, causing the pitman 4 (not shown in FIG. 4) to move. The second eccentric shaft 9, having a larger diameter than the first eccentric shaft 8, does not rotate but rather swings, or oscillates, back and forth following a curved path, i.e. a part of a whole circle, around the lower dead center of the second eccentric shaft. The path and the back and forth movement are shown with a dotted line and an arrow. The amount of swinging and the length of the path depend on the respective sizes and distance of the first 8 and second 9 eccentric shafts, and are chosen in accordance with the situation for a desired stroke movement pattern The movement pattern 14 of the movable jaw, as seen on the vertical diagonal 10 of the crushing chamber is shown in FIG. 4 by referring to letters A, B, C and D. Letters, or points, A, B and C illustrate the crushing stroke path of the pitman 4 and letters, or points, C, D and A illustrates the return path of the pitman 4. It is to be noted that for purposes of illustration, the curvature of the crushing stroke and the return path is exaggerated. The movement pattern shows that the crushing stroke of the movable jaw is substantially linear and perpendicular to the vertical diagonal 10 of the crushing chamber. Furthermore, the return path of the pitman comprises a vertical element between points C and D, wherein the direction is advantageously downwards in the direction of falling crushed material after the crushing stroke. In the embodiment of FIG. 3, the first eccentric shaft 8 rotates counterclockwise, and the second eccentric shaft 9 swings back and forth following a curved path around the upper dead center resulting similarly in a substantially linear crushing stroke perpendicular to the vertical diagonal of the crushing chamber. The return path of the movable jaw is curved, and the inventors have established that the linear crushing stroke is significant, and the curved return path does not significantly affect the crushing process. Furthermore, in the embodiment of FIG. 3 the upper part of the pitman advantageously starts crushing material earlier than the lower part, i.e. the jaw angle does not increase when the crushing stroke begins.

The invention enables creating a significantly improved movement path 14 of the movable jaw of the jaw crusher 100 in terms of efficiency and wear of the wear parts. A substantially linear crushing stroke, as hereinbefore explained, perpendicular to the diagonal of the crushing chamber is achieved. The substantially linear crushing stroke herein means a crushing stroke having a smaller up and down movement of the jaw during the crushing stroke than on the return path.

Furthermore, the invention provides a higher angle of rotation, tens of degrees, e.g. 50 degree when the stroke of the pitman is 20 mm, and thus ensures sufficient lubrication for the bearings of the second eccentric 9. The choice of the distance of the second eccentric 9 from the jaw diagonal 10 is more flexible and provides more freedom in designing the crusher, e.g. for optimizing the X/Y, see FIG. 4, ratio preferably between 2/3 to 4/1.

Furthermore, in the arrangement according to the invention, the dust sealing of bearings is easier, already alone for the fact that less bearings means less sealing need.

Eccentric shafts according to the invention with bearing mounting can be dimensioned robust enough to tolerate high crushing forces. The movement pattern in crushing stroke A, B, C is substantially linear with minimal amount of vertical height variation causing less shearing between crushing parts and crushed material and provides for a less uneven wear of the crusher parts. When the pitman 4 moves in the opposite direction C, D, A, the vertical height variation has no significant effect on the crushing step.

Accordingly, without in any way limiting the scope, interpretation, or application of the claims appearing below, a technical effect of one or more of the embodiments disclosed herein is an increased crushing capacity due to an effective crushing stroke. Another technical effect of one or more of the example embodiments disclosed herein is reduced wear of the wear parts due to the substantially linear crushing stroke. Another technical effect of one or more of the example embodiments disclosed herein is the simplified structure of the crusher as the second eccentric shaft is easier to assemble compared to previous arrangements. A still further technical effect of one or more of the example embodiments disclosed herein is an improved dust sealing of the crusher due to the eccentric shaft mounting points being easy to seal. A still further technical effect of one or more of the example embodiments disclosed herein is cost saving in view of the eccentric shaft arrangement being implementable with standard parts.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of principles of the invention, and not in limitation thereof. Hence, the scope of the invention is only restricted by the appended patent claims.

The invention claimed is:

1. A jaw crusher comprising a fixed jaw and a movable jaw for forming a crushing chamber therebetween which is open at the top, the fixed jaw comprising a first wear part mounted thereto and the movable jaw comprising a pitman and a second wear part mounted thereto; wherein the pitman is rotatably mounted to a first eccentric shaft, wherein the pitman is further rotatably mounted to a second eccentric shaft configured to guide the stroke of the movable jaw to create a movement pattern with a linear crushing stroke, wherein the second eccentric shaft is positioned between the first eccentric shaft and the crushing chamber and the eccentricity of the second eccentric shaft is larger than the eccentricity of the first eccentric shaft.

2. The jaw crusher of claim 1, wherein a horizontal line passing through the center of the first eccentric shaft passes through the lower or upper dead center of the second eccentric shaft.

3. The jaw crusher of claim 2, wherein the horizontal line passing through the center of the first eccentric shaft passes through the middle section of the crushing chamber.

4. The jaw crusher of claim 2, wherein the horizontal line passing through the center of the first eccentric shaft passes through the centerline of the crushing chamber thus dividing the crushing chamber into two parts of equal height (H).

5. The jaw crusher of claim 1, wherein the second eccentric shaft is configured to swing back and forth in response to the first eccentric shaft rotating.

6. The jaw crusher of claim 1, wherein the second eccentric shaft is mounted in such a way that the upper or lower dead center thereof is removed from the horizontal line.

7. The jaw crusher of claim 1, wherein the first eccentric shaft and the second eccentric shaft are bearing-mounted to a body of the jaw crusher and to the pitman.

8. The jaw crusher of claim 1, wherein the radius of the second eccentric shaft is between 2 and 4 times that of the radius of the first eccentric shaft.

9. A mineral material processing plant, wherein the mineral material processing plant comprises a jaw crusher of claim 1.

10. A mineral material processing plant of claim 9, wherein the mineral material processing plant is a mobile processing plant.

11. A method for processing mineral material comprising the steps of:

providing a jaw crusher including a fixed jaw and a moveable jaw that form a crushing chamber therebetween which is open at the top, the fixed jaw including a first wear part mounted thereto and the moveable jaw including a pitman and a second wear part mounted thereto, wherein the pitman is rotatably mounted to a first eccentric shaft and to a second eccentric shaft configured to guide the stroke of the moveable jaw to create a movement pattern with a linear crushing stroke, wherein the second eccentric shaft is positioned between the first eccentric shaft and the crushing chamber and the eccentricity of the second eccentric shaft is larger than the eccentricity of the first eccentric shaft; and directing a linear crushing stroke to the material to be crushed in the crushing chamber by swinging the second eccentric shaft back and forth in response to the first eccentric shaft rotating.

12. The method of claim 11 wherein the jaw crusher is provided within a mineral material processing plant.

* * * * *